US008132696B2

(12) United States Patent
Mileti

(10) Patent No.: US 8,132,696 B2
(45) Date of Patent: Mar. 13, 2012

(54) METERING DISPENSING SYSTEM WITH ONE-PIECE PUMP ASSEMBLY

(75) Inventor: Robert J. Mileti, Torrington, CT (US)

(73) Assignee: Sealed Air Corporation (US), Elmwood Park, NJ (US)

( * ) Notice: Subject to any disclaimer, the term of this patent is extended or adjusted under 35 U.S.C. 154(b) by 0 days.

(21) Appl. No.: 13/030,746

(22) Filed: Feb. 18, 2011

(65) Prior Publication Data

US 2011/0253738 A1 Oct. 20, 2011

Related U.S. Application Data

(63) Continuation of application No. 12/832,798, filed on Jul. 8, 2010, now abandoned, and a continuation-in-part of application No. 12/052,338, filed on Mar. 20, 2008, now Pat. No. 8,061,566, which is a continuation-in-part of application No. 11/951,351, filed on Dec. 6, 2007, now Pat. No. 7,997,454, which is a continuation-in-part of application No. 11/074,817, filed on Mar. 8, 2005, now Pat. No. 7,419,322.

(60) Provisional application No. 61/223,883, filed on Jul. 8, 2009, provisional application No. 60/914,243, filed on Apr. 26, 2007, provisional application No. 60/551,993, filed on Mar. 10, 2004.

(51) Int. Cl.
*B65D 37/00* (2006.01)

(52) U.S. Cl. ..... 222/207; 222/213

(58) Field of Classification Search ..... 222/207, 222/209, 213, 214, 182, 183, 335, 206, 581, 222/632, 633, 105, 212, 380; 401/184, 188 A
See application file for complete search history.

(56) References Cited

U.S. PATENT DOCUMENTS

| | | | | |
|---|---|---|---|---|
| 886,984 | A | | 5/1908 | Jopling |
| 1,217,054 | A | | 2/1917 | Pearman |
| 1,941,745 | A | | 1/1934 | Higley |
| 2,714,475 | A | | 8/1955 | Roehrich |
| 2,855,127 | A | | 10/1958 | Lerner et al. |
| 3,223,289 | A | | 12/1965 | Bouet |
| 3,396,419 | A | | 8/1968 | Richter et al. |
| 3,507,586 | A | | 4/1970 | Gronemeyer et al. |
| 3,617,139 | A | | 11/1971 | Ross |
| 3,752,366 | A | * | 8/1973 | Lawrence, Jr. ..... 222/207 |
| 3,820,689 | A | | 6/1974 | Cocita |
| 3,949,137 | A | | 4/1976 | Akrongold et al. |
| 3,981,106 | A | | 9/1976 | Gallo |
| 4,004,854 | A | | 1/1977 | Breer, II |
| 4,074,944 | A | | 2/1978 | Xavier |
| 4,098,434 | A | | 7/1978 | Uhlig |
| 4,124,316 | A | | 11/1978 | O'Rourke |
| 4,127,515 | A | | 11/1978 | MacRae et al. |
| 4,188,989 | A | | 2/1980 | Andersen |
| 4,702,397 | A | | 10/1987 | Gortz |

(Continued)

*Primary Examiner* — Lien Ngo
(74) *Attorney, Agent, or Firm* — St. Onge Steward Johnston & Reens LLC

(57) ABSTRACT

A liquid dispensing device includes a storage container having an opening and dome pump assembly attached thereto substantially over the opening for metered dispensing. The dome pump assembly is integrally formed with a dome button, top portion extension and valve to facilitate manufacture and reduce costs of the pump while improving performance thereof. The valve is employed to pull liquid from the storage container into the dome for metering. An exit passageway formed from the extension and container wall serves as an output valve. The user squeezes the dome and the opposite side of the container pouch concurrently to seal the flapper valve to urge liquid out through the exit passageway for actual dispensing.

20 Claims, 5 Drawing Sheets

U.S. PATENT DOCUMENTS 4,753,006 A 6/1988 Howe
4,760,642 A 8/1988 Kwak
4,809,432 A 3/1989 Schauble
4,886,388 A 12/1989 Gulker et al.
4,888,868 A 12/1989 Pritchard
4,889,441 A 12/1989 Tice
4,890,744 A 1/1990 Lane, Jr. et al.
4,993,594 A 2/1991 Becker et al.
5,014,427 A 5/1991 Byrne
5,074,765 A 12/1991 Pekar
5,114,255 A 5/1992 Villarreal
5,168,628 A 12/1992 Mock et al.
5,176,510 A 1/1993 Nilsson
5,261,570 A 11/1993 Hippely et al.
5,265,772 A 11/1993 Bartasevich et al.
5,303,851 A 4/1994 Libit et al.
5,337,478 A 8/1994 Cohen et al.
5,353,961 A 10/1994 Debush
5,356,039 A 10/1994 Christine et al.
5,372,487 A 12/1994 Pekar
5,387,207 A 2/1995 Dyer et al.
5,413,250 A * 5/1995 Gueret ..... 222/105
5,441,345 A 8/1995 Garvey et al.
5,482,980 A 1/1996 Pcolinsky
5,505,341 A 4/1996 Gueret
5,555,673 A 9/1996 Smith
5,564,190 A 10/1996 Fleetwood
5,640,737 A 6/1997 Boggs
5,700,245 A 12/1997 Sancoff et al.
5,701,674 A 12/1997 Mitchell
5,704,723 A 1/1998 Salisian
5,761,813 A 6/1998 Frick et al.
5,836,482 A 11/1998 Ophardt et al.
5,842,607 A 12/1998 Snider
5,855,066 A 1/1999 Manger
5,865,554 A 2/1999 Lin
5,934,296 A 8/1999 Clay
5,944,032 A 8/1999 Masterson
5,950,928 A 9/1999 Giang et al.
5,983,500 A 11/1999 da Silva
6,012,613 A 1/2000 Chen
6,183,154 B1 2/2001 Coe
6,210,064 B1 4/2001 White et al.
6,251,098 B1 6/2001 Rake et al.
6,302,607 B1 10/2001 Burrowes et al.
6,394,316 B1 5/2002 Daansen
6,406,207 B1 6/2002 Wiegner et al.
6,419,118 B1 7/2002 Rees et al.
6,558,629 B1 5/2003 Davidson
6,623,201 B2 9/2003 Brumlik
6,629,799 B2 10/2003 Flores, Jr.
6,641,307 B2 11/2003 Matsuda et al.
6,715,952 B1 4/2004 Aiken et al.
6,754,958 B2 6/2004 Haws et al.
6,789,321 B2 9/2004 Simms
6,789,706 B2 9/2004 Abergel et al.
6,843,368 B1 1/2005 Frutin
6,883,563 B2 4/2005 Smith
6,886,254 B1 5/2005 Pennella
6,910,274 B1 6/2005 Pennella et al.
6,925,716 B2 8/2005 Bressler et al.
6,929,155 B1 8/2005 Sayers
6,964,097 B2 11/2005 Franzini et al.
6,996,908 B2 2/2006 Orloff et al.
7,043,841 B2 5/2006 Franzini et al.
7,121,754 B2 10/2006 Bressler et al.
7,137,203 B2 11/2006 Bressler et al.
7,137,531 B2 11/2006 Arghyris et al.
7,156,132 B2 1/2007 O'Dougherty et al.
7,159,742 B2 1/2007 Lee
7,357,335 B2 * 4/2008 Laidler et al. ..... 239/302
7,456,132 B2 11/2008 Yamamoto et al.
2001/0025859 A1 10/2001 Dumont
2001/0025860 A1 10/2001 Auer
2002/0085873 A1 7/2002 Katsandres et al.
2003/0077106 A1 4/2003 Weihrauch
2003/0121936 A1 7/2003 De Laforcade
2004/0092864 A1 5/2004 Boehm, Jr. et al.
2004/0140326 A1 7/2004 Smart et al.
2004/0177510 A1 9/2004 Pennella
2004/0178284 A1 9/2004 Fahy et al.
2005/0138814 A1 6/2005 Pennella et al.
2005/0144785 A1 7/2005 Bressler et al.
2005/0199651 A1 9/2005 Laflamme et al.
2006/0072858 A1 4/2006 Kurosawa et al.
2006/0150386 A1 7/2006 Wanli et al.
2006/0254056 A1 11/2006 Coffin et al.
2006/0255068 A1 11/2006 Genosar
2006/0272154 A1 12/2006 Brevard
2007/0017098 A1 1/2007 Bressler et al.
2007/0084058 A1 4/2007 Szczepanowski et al.
2007/0214646 A1 9/2007 Bezdek
2008/0264973 A1 10/2008 LaFlamme et al.
2008/0277427 A1 11/2008 Rossignol
2009/0032554 A1 2/2009 Laidler et al.

* cited by examiner

METERING DISPENSING SYSTEM WITH ONE-PIECE PUMP ASSEMBLY

CROSS-REFERENCE TO RELATED APPLICATIONS

This application is a continuation of U.S. patent application Ser. No. 12/832,798, filed Jul. 8, 2010, now abandoned which claims the benefit under 35 U.S.C. §119 (e) of the U.S. Provisional Patent Application Ser. No. 61/223,883, filed on Jul. 8, 2009. The application Ser. No. 12/832,798 is also a continuation-in-part of U.S. patent application Ser. No. 12/052,338, filed Mar. 20, 2008, now U.S. Pat. No. 8,061,566 which in turn is a continuation-in-part of U.S. patent application Ser. No. 11/951,351, filed Dec. 6, 2007, now U.S. Pat. No. 7,997,454 which application claims the benefit under 35 U.S.C. §119 (e) of the U.S. Provisional Patent Application Ser. No. 60/914,243, filed Apr. 26, 2007. The application Ser. No. 12/832,798 is also a continuation-in-part of U.S. patent application Ser. No. 11/074,817, filed Mar. 8, 2005, now U.S. Pat. No. 7,419,322, issued Sep. 2, 2008, which in turn claims the benefit under 35 U.S.C. §119 (e) of the U.S. Provisional Patent Application Ser. No. 60/551,993, filed Mar. 10, 2004.

FIELD OF THE INVENTION

This invention relates generally to dispensing devices and packages. More specifically, the present invention relates to metering devices that can controllably dispense fluid media from a source of fluid media.

BACKGROUND OF THE INVENTION

Various types of fluid material and media are employed for different purposes throughout commerce and industry. For example, there are various products in the personal care, home care, air care, transportation care, and food industries that require some type of dispensing of a fluid material from a source of such material. When this material is sold in commerce, it must be contained and stored in some type of container. When that product is used, it must be dispensed from its storage container to a location for use.

In the prior art, there are many different types of dispensers that are employed for the delivery of a stored fluid material to its desired location for use. For example, a storage container having a flexible body with a nozzle tip extending therefrom is commonly provided for such a purpose. An example of such use can be seen in the context of a ketchup dispenser, where a user squeezes the container body to urge the fluid material (i.e., ketchup) out from the container body and through the nozzle tip to accurately deposit the fluid material at the desired location. In such an application, the amount of fluid that is ultimately delivered is determined by how much the user actually squeezed the container body. While this method has provided marginally acceptable results, this method also typically yields an erratic fluid volume since more or less fluid material may be delivered on each successive squeeze of the container body. Also, the container must be held upright to avoid leakage because no valves are employed in the fluid nozzle tip.

In another example of a prior art dispensing device, a flexible container is provided that holds a volume of fluid material to be delivered. In an attempt to overcome the leakage issue noted above, a single one-way check valve is provided at the exit port of the flexible container. When the flexible body is squeezed, the material is urged out under pressure through the valve. The difficulty here is that the valve over time becomes partially clogged thereby requiring that the user apply additional pressure to cause the valve to open. As a result, once the valve opens, the additional pressure causes more fluid material to be deposited than the user typically would have desired.

U.S. Pat. No. 7,419,322 represents a significant advancement over the above-described systems by providing a fluid dispensing device that includes a container with an interior fluid storage region therein. A flexible metering housing is disposed in fluid communication with the fluid storage region with a first one-way valve disposed between the container and the flexible metering housing. One way flow from the interior fluid storage region of the container fills the predetermined volume of the metering chamber with fluid by vacuum action when a button is depressed and then released. A second valve is in fluid communication with the metering housing and permits one-way fluid flow from the metering chamber to the exterior outer region of the container when the metering housing is depressed again. Each time the metering housing is depressed a substantially equal volume of fluid is dispensed from the container.

While the configuration and operation of this metering pump assembly provides excellent results, it should be recognized that it includes at least three separate elements, specifically a flexible button, an intake valve and an output valve. In some situations, it may be desirable to simplify this configuration by integrating various functions and/or reducing the number of parts.

U.S. Patent Application Publication No. 2008/0264973 discloses various embodiments that possess such a simplified design, wherein the valving and dispensing functions are incorporated into a design that is relatively simplified and cost-effective to produce, yet that also provides excellent results. However, even in the embodiment incorporating the fewest number of elements (shown in FIG. 17 of US 2008/0264973), the metering pump assembly includes two separate parts, i.e., one element incorporating dome button (608 of FIG. 17) and top portion (610 of FIG. 17) and another element incorporating base plate (602 of FIG. 17) and bottom portion (604 of FIG. 17).

In some cases, an even further simplified design may be desirable

SUMMARY OF THE INVENTION

In this regard, the present invention preserves many of the advantages of the devices disclosed in U.S. Pat. No. 7,419,322 and U.S. Patent Application Publication No. 2008/0264973, while employing a metering pump assembly that is even simpler in design, specifically comprising only a single integrated piece.

In accordance with one embodiment of the present invention, a fluid dispensing device includes a flexible pouch having a wall defining an interior compartment, the wall of the pouch having an opening passing therethrough from the interior compartment to an exterior of the pouch. A dome button with a top portion extension extending thereof is sealed to the exterior of the pouch in the vicinity of the opening around most of the periphery thereof to define a metering chamber. However, the end of the top portion extension is left unsealed such that the top portion extension and the exterior surface of the pouch define an exit pathway for the fluid when the dome button is depressed, with the top portion extension and the exterior of the pouch also forming a one-way exit valve.

A valve is also incorporated into the integrated construction of the dome button and top portion extension. The integrally formed valve includes an arm that extends from the dome button to provide a protrusion on the free end thereof to sealingly engage with the opening through the pouch to thereby form the one-way intake valve.

The valve may be spring-biased in such a fashion to be slightly open when at rest so that liquid may return to the pouch and not exit through the exit pathway, in the form of leakage, when pressure is accidentally placed on the dome button. Stand-off legs inside the dome may be used to retain the valve closed during desired dispensing. It is also possible that the valve may be spring-biased downwardly so that the intake valve member is normally closed so that on a down stroke of the dome button, the intake valve remains closed and metered liquid residing in the dome is urged out through the exit pathway as defined between the top portion extension and the exterior surface of the pouch. On an upstroke of the dome button, the intake valve lifts off the opening through the pouch to permit loading of liquid from the pouch into the metering chamber of the dome button.

As shown in the appended Figures, an upstanding circumferential wall is positioned about the dome button to prevent unwanted actuation thereof. The wall is preferably integrally molded with the dome button and the top portion extension. The wall is preferably relatively rigid and is not easily compressed when pressure is placed generally across it. Thus, to actuate the dome button for pumping, the flexible dome button itself must be specifically depressed, such as by a user's finger. As a result, actuation of the pump assembly is more likely to be carried out only when specifically desired. The integrated formation of parts makes the manufacture easier and less costly while retaining if not improving performance because there are less welds in the finished assembly.

Even though the pump includes a one piece construction, it can still carry out automatic shut-off of the exit passageway when pressure is exerted on the exterior of the pouch to help prevent leakage, because pressure on the pouch will force the exterior of the pouch in the area defining the exit passageway toward the top portion extension thereby tending to collapse, flatten and squeeze closed the exit passageway. Any material residing in the exit passageway is thus urged back into the chamber of the flexible dome button. As a result, unwanted leakage is further avoided when accidental or unintentional pressure is placed on the pouch.

Although not shown in the appended Figures, to further help prevent unwanted dispensing and leakage from the pump assembly of the present invention, a single use or re-sealable closure may be used.

The integrated dome button, top portion extension and valve can be made of any suitable material, such as a plastic or elastomeric material, and combinations thereof. The integrated components can be more rigid or more flexible depending on the application at hand. The pouch can also be made of any of a number of suitable materials or combination of materials, with a plastic or elastomeric flexible sheet material being preferred in some embodiments. In some applications, it may also be desirable for different portions of the pouch to be formed from different materials. For example, in some embodiments, the upper wall of the pouch (i.e., the wall to which the pump assembly is sealed) may be formed from a flexible sheet material, while the lower wall of the pouch may be formed from a rigid or semi-rigid material. Use of other materials and/or combinations of materials is also contemplated.

In view of the foregoing, the present invention is well suited for providing controlled metered delivery of liquid in any type of pouch configuration, such as stand-up pouches (SUP) gusseted pouches, printed pouches, reclosable zipper pouches as well as pouches and other vessels that include some type of tear away or punch hole exit port. For example, a hand cleaner dispenser with a tear away exit port would be particularly well-suited for a pump assembly configuration according to the present invention.

In general, the present invention can include valve geometry that can easily be modified to handle a large range of viscosities by, for example: 1) modifying the exit pathway width; 2) creating backflow pressure through weld footprints; 3) modifying the shape of the exit pathway; 4) modifying the size and shape of the opening through the pouch; 5) modifying the size, length and configuration of the stand-off legs on the dome button (if provided); 6) modifying the size, shape, flex and configuration of the one-way valve; and (7) incorporating a nozzle in the exit pathway. Also, the exit valve configuration can easily be modified to adjust the automatic shut-off pressure.

The pump assembly of the present invention has a wide array of applications of use to take advantage of the unique metered dosage capability of the present invention. Virtually any dispenser with any type of applicator material or combinations of applicator materials in different configurations can employ the present invention.

For example, the cleaning products and personal care industry has particular application in the controlled and metered dispensing of bath and shower gels. Also, medicines, cosmetics, hair care products, such as shampoos, skin care products, such as lotions, insect repellants and sunscreen products can employ the present invention. Also, various home products can be delivered in a device according to the present invention. These include products for furniture cleaning and polishing, tub and shower cleaning, floor cleaning and polishing, window cleaning, odor elimination, oven cleaning, laundry cleaning and apparel treatment. Also, air treatment devices can employ the present invention. Cleaning products can be dispensed in a controlled fashion, such as those for cleaning cars, bikes, planes and trucks. The dispensing device is particularly adapted for the personal transport and metered dispensing of sanitizers in liquid or gel form. The food industry has numerous potential applications, particularly for the dispensing of condiments, sauces, vitamins, beverages, beverage concentrates and beverage additives.

It is therefore an object of the present invention to provide a fluid dispensing device that can deliver a substantially equal volume of fluid material from each dispensing operation.

Another object of the present invention is to provide a fluid dispensing device that prevents inadvertent or accidental dispensing of liquid from the storage container when pressure is inadvertently or accidentally applied to the dome pumping mechanism or storage container of the dispenser.

It is a further object of the present invention to provide a fluid dispensing device that is insensitive to gravity.

Another object of the present invention to provide an exterior metering dispensing system that has a number of components integrally formed to better incorporate the pump assembly into a given application and simplify manufacturing and assembly of the container onto which it is installed.

It is yet a further object of the invention to provide a method of dispensing fluid by sealing an integrally formed pump assembly to a container.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE INVENTION

Figure 1:
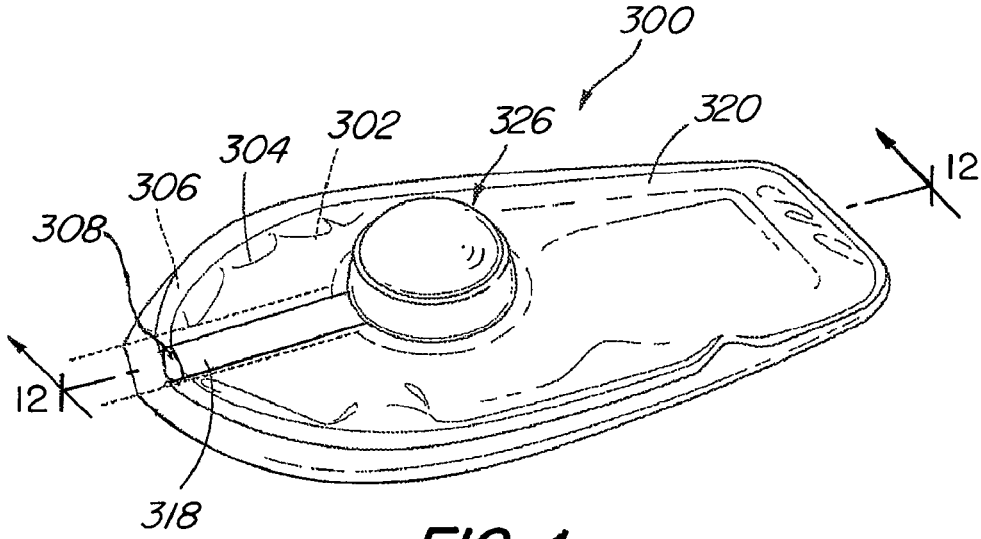
FIG. 1 is a perspective view of an embodiment of a metering dispensing system with one-piece pump assembly of the present invention that includes valving to prevent inadvertent or accidental dispensing of liquid therefrom.

Turning now to FIGS. 1-4, details are shown of a device 300 that includes the improved dispensing device of the present invention that prevents inadvertent or accidental dispensing of liquid 302 even when pressure is placed on the dome button 404 or storage container 320. An efficient method of manufacturing a quality dispensing device 300 is to employ heat welding to construct the container 320. For example, a top sheet 304 is typically heat welded to a bottom sheet 306 about their periphery to form a container 320 with an interior fluid storage region 322 therein. Other types of bonding, e.g. adhesive, are also contemplated.

The term weld, as used herein, is meant to include seal, adhere, bond, etc. Welding may be accomplished by heat, vibration, chemical, adhesive, ultrasonic or any other means of joining polymers known to those of ordinary skill in the art.

The term seal, as used herein, may be accomplished by pressure, heat, vibration, chemical, adhesive, ultrasonic or any other means of joining polymers known to those of ordinary skill in the art.

FIG. 1 illustrates a perspective view of a metering dispenser 300 that employs the improved one-piece pump assembly in accordance with the present invention. An outer storage container 320 is provided that may be formed of two sheets of material 304, 306 secured together, such as by welding, a tube of material, sealing, adhesives, etc. A metering pump, comprised of an upper member 326, pulls liquid 302 from the storage container 320, meters it, and then dispenses it through top portion extension 318 that forms a pathway to an exit port 308.

Figure 2:
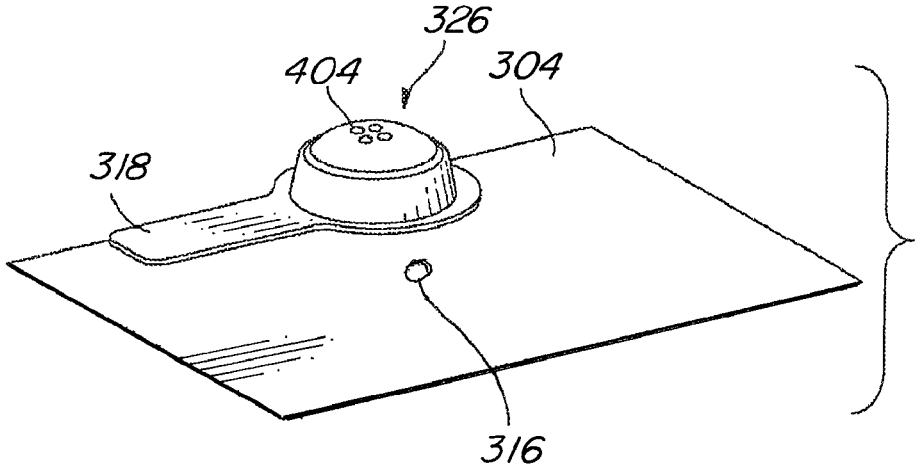
FIG. 2 is a front exploded perspective view of the metering dispensing system shown in FIG. 1.

FIG. 2 shows an exploded view of the top sheet 304 of material that forms a top portion of the storage container 320 and the metering pump 326 that is shown in FIG. 1. The metering pump or upper member 326 is installed onto a sheet of material 304, which serves as the top wall of the storage container 320. The sheet of material 304 includes an opening 316 passing from the interior compartment of storage container 320 to the exterior of the container. The dome button 404 of the upper member 326, in the form of a flexible housing, is positioned above the opening 316. The top portion extension 318 is positioned on the upper surface of the top sheet of material 304 that forms the storage container 320 for the dispensing device 300. The upper member 326, which includes the top portion extension 318 and a flapper valve 408, is welded at its periphery to the sheet 304 to form the pump construction. Since the top portion extension 318 and the top sheet of material 304 lie adjacent to one another, this structure also serves as an exit valve to prevent further unwanted flow of liquid 302 from the device.

Figure 3:
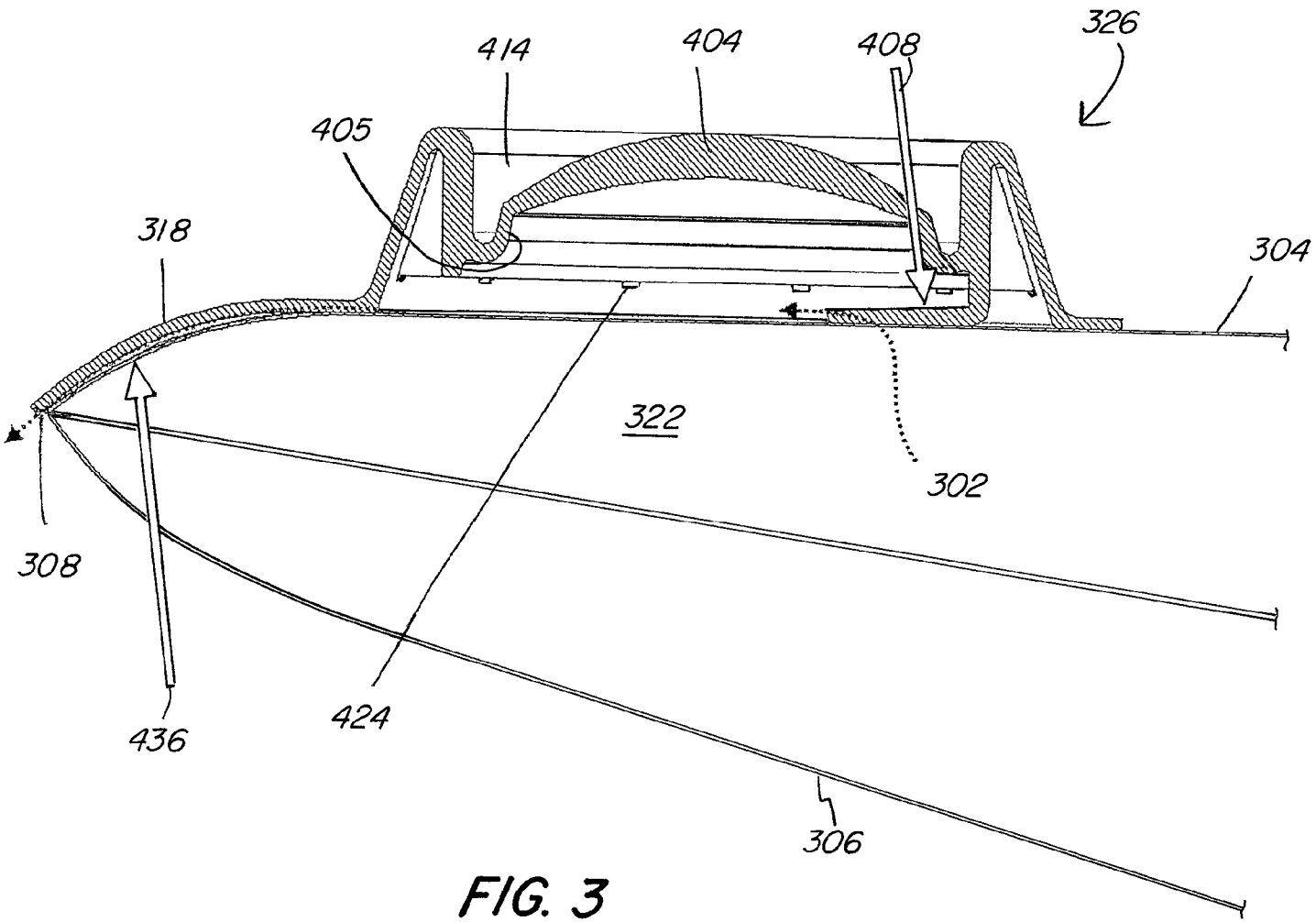
FIG. 3 is a cross-sectional view, through line 12-12 of FIG. 1, of a metering dispensing system of the present invention.
Figure 4:
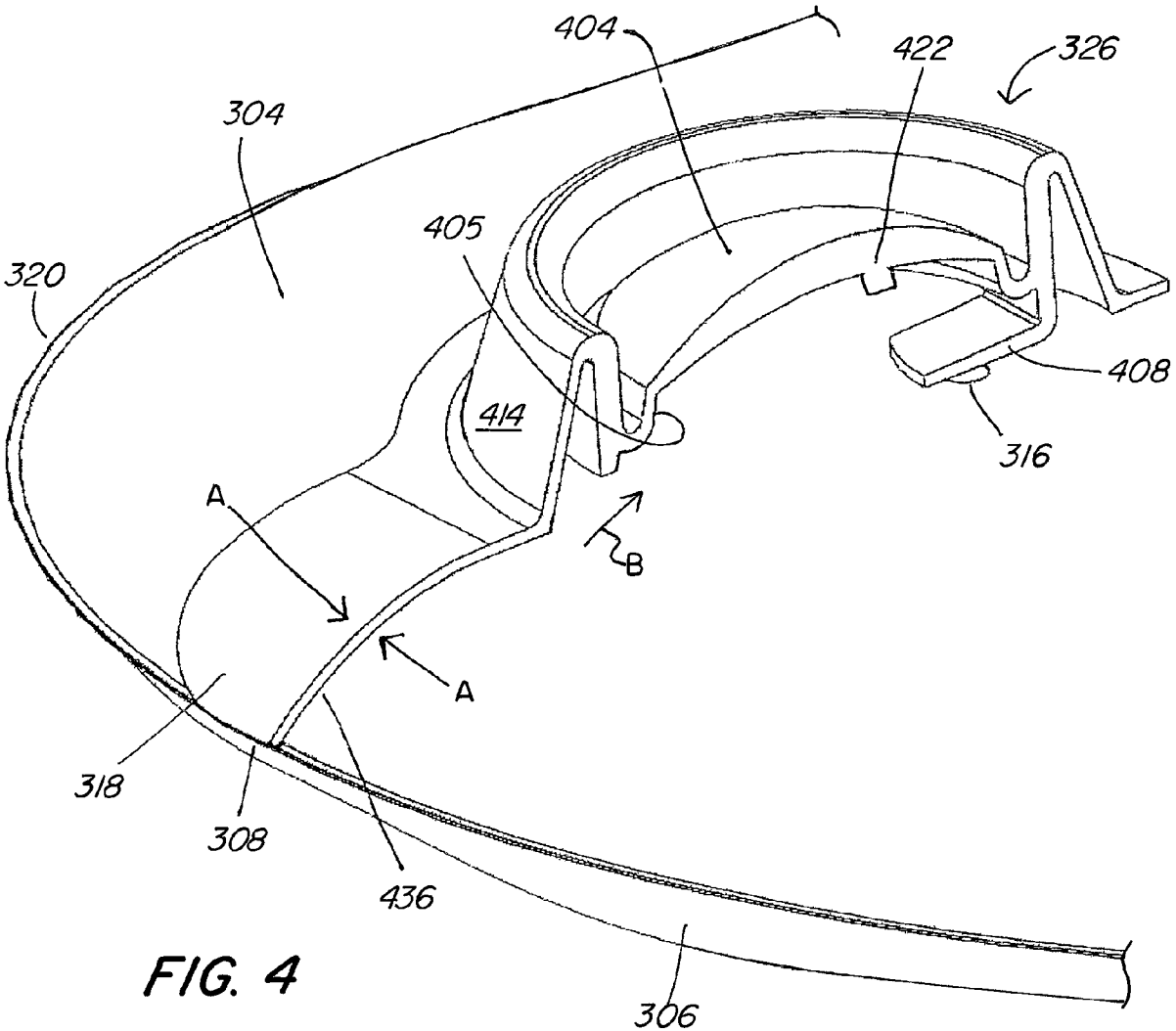
FIG. 4 is a perspective cross-sectional view, through line 12-12 of FIG. 1, of a metering dispensing system of the present invention.
Figure 6:
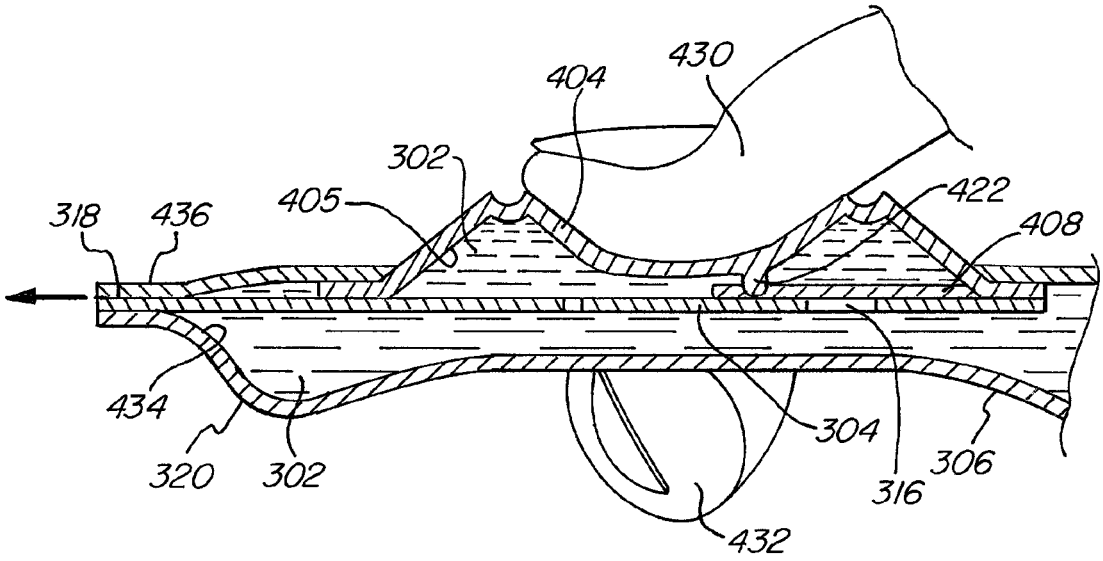
FIG. 6 is a cross sectional view through line 12-12 of FIG. 1 illustrating actual dispensing of the fluid.

Turning now to FIGS. 3, 4 and 6, further details of the operation of the metering dispensing system are shown. FIG. 3 illustrates a cross-sectional view, through the line 12-12 of FIG. 1, of the one-piece pump assembly of a metering dispensing system of the present invention. Valving in the assembly prevents any inadvertent or accidental dispensing of liquid 302 from the storage container 320 when pressure is accidentally or inadvertently applied to the dome button 404. Stand-off legs 422, 424 are provided on the underside of the top of the flexible dome button 404 or the underside of wall 414.

More specifically, the dispensing operation actually requires application of force to the flexible dome button 404 of the upper member 326, as well as the exterior sheet 306 of the container or pouch. Since it is unlikely that the force would be inadvertently or accidentally applied to these two areas simultaneously, the likelihood of accidental or inadvertent dispensing of liquid is substantially eliminated.

Resting above the opening 316 and within the cavity 405 of the dome 404 of the upper member 326 of the present invention is a flapper valve 408. Although a flapper valve is depicted and further described herein, it is not meant to be limiting. Many types of valves are contemplated by the invention. For instance, a valve having a thin stalk-like piece with a bead on the end could hang down from the inside top of the dome. It is possible that this flapper valve 408 be configured in a normally open condition but may also be configured to lie flat when at rest. As long as the exterior sheet 306 substantially below the dome 404 of the upper member 326 is not forcefully depressed, the flapper valve 408 does not seal against the opening 316 such that any inadvertent contact with the flexible dome pump housing 404 does not result in the dispensing of the product. Instead, since the flapper valve 408 is open, liquid product residing inside the cavity 405 of the upper member 326 will tend to simply flow back through the opening 316 to the reservoir within the storage container 320 itself rather than flow undesirably out through the exit valve to outside of the dispenser. In use, if a person has the dispenser in their pocket or purse and pressure is accidentally or unintentionally placed on the flexible dome button 404 of the upper member 326, liquid will not flow outside the dispenser thereby preventing a mess from being made due to unintentionally dispensed product.

FIGS. 3 and 4, show a circumferential upstanding wall 414 that encircles dome button 404 that is depressed for metered dispensing. The upstanding wall 414 helps prevent unwanted depression of the dome button 404. The wall 414 is integrally molded with the dome button 404, the flapper valve 408 and the top portion extension 318. The wall 414 is preferably rigid and is not easily compressed when pressure is placed generally across it. Thus, to actuate the dome button 404 for pumping, the flexible dome button 404 itself must be specifically depressed, such as by a user's finger. As a result, actuation of the pump assembly 326 is more likely to be carried out only when specifically desired. The integrated formation of parts makes the manufacture easier and less costly while retaining if not improving performance because there are less welds or seams in the finished assembly.

FIG. 6 illustrates intentional dispensing of liquid 302. When it is desired to actually dispense the liquid product 302, the user's thumb 430 can depress the flexible dome 404 and the user's index finger 432 can concurrently apply activating force to the portion of the exterior sheet 306 of the container that is substantially below dome button 404 of the upper member 326 such that flexible dome 404, with the assistance of the stand-off legs 422 under the flexible dome, securely seals and provides a positive lock of the flapper valve 408 over and about the opening 316 thereby closing the liquid flow passage back into the reservoir 434 of the storage container 320. Thus, the only path for the liquid 302 contained within the cavity 405 of dome 404 is to exit through the exit passageway 436, formed by the top portion extension 318 and the sheet of material 304, for intended dispensing of the product, as indicated by the arrows in FIG. 6.

It should be understood that the stand-off legs 422 on the bottom of the flexible dome button 404 can be modified in size, length and configuration to adjust the amount of squeezing necessary by the user's fingers 430, 432 to effectuate sealing of the flapper valve 408. For example, preferably four stand-off legs 422 are provided on the bottom of the flexible dome housing 404 in a 2×2 array and can be 1/32 of an inch in length. It is also possible that these stand-off legs 422 can be a single downwardly depending wall, such as in the shape of a circle or square. Such an array is configured to downwardly press against the one-way flapper valve 408 outside of the diameter of the opening 316 to provide a good seal of the flapper valve 408 to top sheet of material 304.

Turning again to FIG. 4, the present invention provides further structure to prevent unwanted dispensing of liquid. In addition to the improved one-piece pump assembly, as above, automatic shut-off of the exit port passageway 436, when pressure is exerted on the exterior of the storage container 320, serves to prevent leakage. In FIG. 4, when pressure is applied to the outside of the storage container or pouch 320, as indicated by arrows referenced A, the exit port passageway 436 tends to collapse, flatten and squeeze closed. As a result, any material residing in the passageway is urged back into the cavity 405 of the upper member 326, as indicated by arrow referenced B. As a result, unwanted leakage is prevented when accidental or unintentional pressure is placed on the storage container 320.

Referring back to FIG. 6, the operation of a dispensing device of the present invention is further explained. The dome button 404 of the upper member 326 is depressed to initiate a vacuum operation. More specifically, when the button 404 is further released, fluid 302 is pulled from the fluid storage region 434 of the container body 320 into the metering cavity 405, which is configured to be of a certain known volume. The act of releasing the button 404 fills the metering cavity 405 to substantial capacity. Thus, a metered amount of fluid material 302 is contained within the cavity 405 in preparation for delivery. The size of the metering cavity 405 can be selected according to the type of fluid material 302 to be dispensed and the application therefore and the desired dosage volume. Further depression of the button 404 urges the measured volume of fluid 302 within the metering cavity 405 through the exit pathway 436 and out of exit port 308, as shown in FIG. 3.

Figure 5:
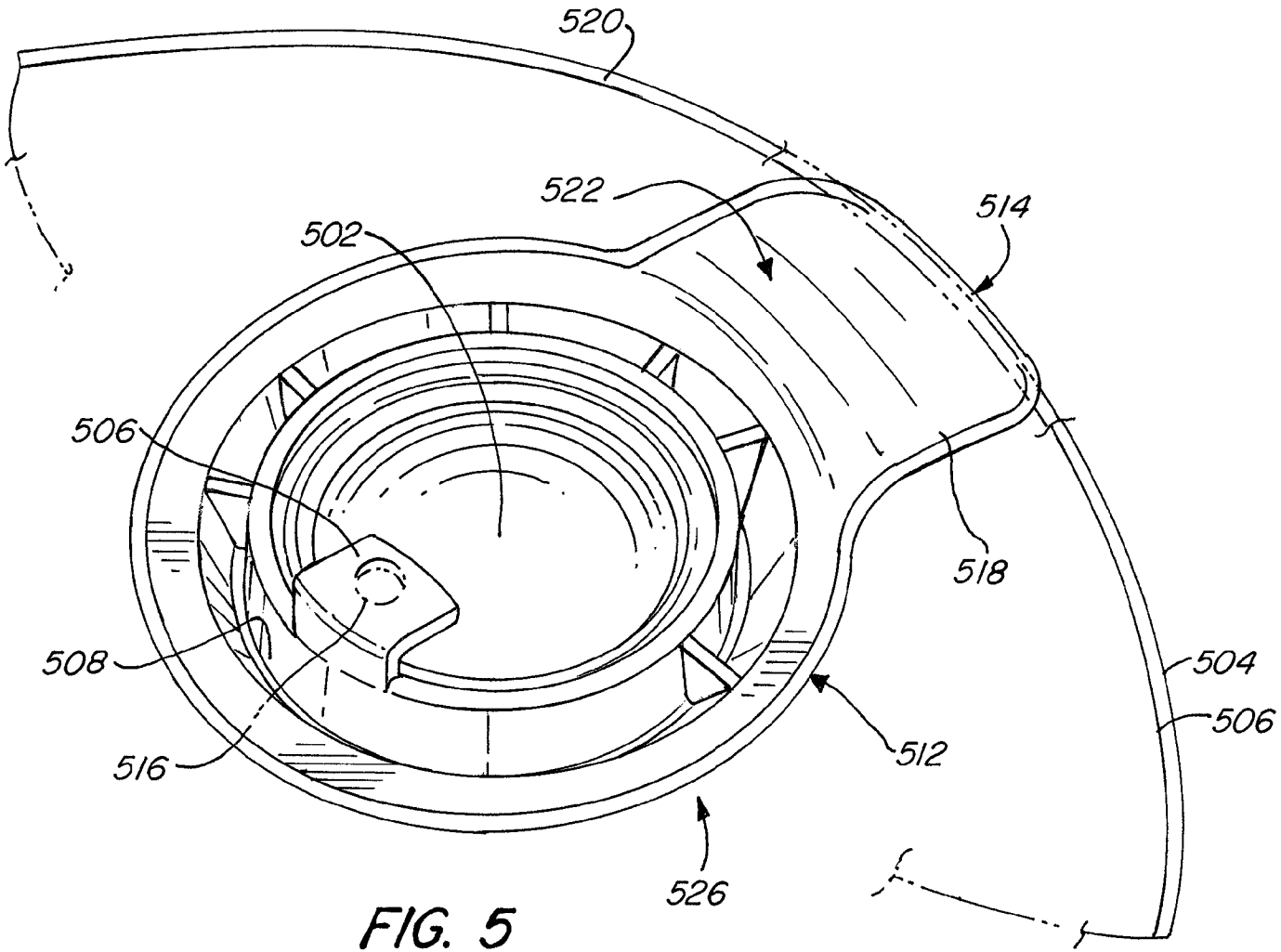
FIG. 5 is a bottom perspective view of a metering dispensing system with one-piece pump assembly of the present invention.

FIG. 5 shows a perspective bottom view of the metering dispensing system with a one piece pump assembly of the present invention. In this embodiment, the storage container is a transparent pouch 520 having a top sheet 504 of material that forms a top wall of the pouch 520 and a bottom sheet of material 506 sealed to the top sheet 504 such that an interior compartment or pouch 520 for maintaining fluid is formed between the two sheets 504 and 506. The top sheet 504 has an opening 516 passing therethrough from the interior compartment to the exterior of the pouch. The underside of an integrally formed one-piece pump assembly 526 having a dome button 502, top portion extension 518 and flapper valve 508 having an arm 506 that extends from the dome button 502 to provide a protrusion is visible through the transparent pouch 520. The arm 506 of the flapper valve 508 is positioned above the opening 516. The top portion extension 518 extends to the wall of the pouch 520. The pump assembly 526 is sealed to the top sheet 504 along the weld line 512. An exit pathway 522 is formed from the top portion extension 518 and the exterior surface of the top pouch sheet 504. An exit port 514 is formed where the top portion extension meets the pouch wall.

Also, the exit pathway 522 may be equipped with a tear-off closure (not shown) that must be first removed or opened by the user to permit flow of liquid from the exit pathway 522 for use. Essentially, the tear-off closure is preferably a member that is connected to the top portion extension 518 by a weakened or thinned length of material while still sealing the exit port 514. This permits the tear-off closure to be removed with little effort by the user but not so easily that it will disconnect by accident, such as during transport. The tear-off closure is particularly useful to prevent leakage during transport of a dispenser that uses the pump assembly 526 prior to a first use. Such a tear-off closure may be employed in any of the embodiments of the present invention.

Alternatively, to further help prevent unwanted dispensing and leakage from a dispenser equipped with the pump mechanism of the present invention, a re-sealable closure as described and shown in FIG. 17 of U.S. 2008/0264973 A1, incorporated herein by reference, may be used. Further, the re-sealable closure may be used in any of the embodiments of the present invention.

It should also be understood that these described closure mechanisms are just examples of the many different types of closures that can be used while still being within the scope of the present invention.

In summary, a new and novel dispenser is provided that can deliver consistent metered dosages of fluid material. The dispenser has a greatly improved construction. Namely, a number of components can be integrally formed to better incorporate a metered dome pump into a given application and to simplify the manufacturing and assembly of the pump and dispenser into which it is installed. Further, improved valving prevents accidental or inadvertent dispensing of liquid when pressure is placed on the flexible dome housing or body of the storage container or pouch. It would be appreciated by those skilled in the art that various changes and modifications can be made to the illustrated embodiments without departing from the spirit of the present invention. All such modifications and changes are intended to be covered by the appended claims

What is claimed is:

1. A dispensing device, comprising:

a collapsible pouch having an interior, an exterior and an opening passing between the interior and the exterior;

a one-piece upper member having a dome button, a valve positioned within the dome button and a top portion extension extending distally from the dome button, the one-piece upper member being sealed to the exterior of the collapsible pouch about the opening to define a metering chamber, and the valve positioned to sealingly engage with the opening;

an exit pathway formed between the top portion extension and the exterior of the collapsible pouch; and the one-piece upper member being configured to draw fluid from the pouch, through the opening and into the metering chamber; the one-piece upper member being further configured to urge liquid through the exit pathway when the valve of the one-piece upper member is sealingly engaged against the opening in the pouch to prevent a flow of liquid therethrough.

2. The dispensing device of claim 1, further comprising a one-way exit valve in fluid communication with the exit pathway.

3. The dispensing device of claim 1, further comprising at least one housing stand-off leg positioned inside the dome.

4. The dispensing device of claim 1, wherein the valve is spring-biased to be slightly open when at rest.

5. The dispensing device of claim 1, wherein the valve is spring-biased downwardly.

6. The dispensing device of claim 1, wherein the one-piece upper member also comprises a circumferential wall having an upper rim positioned about the dome button, wherein the upper rim of the circumferential wall defines a plane, and an entirety of the dome is positioned below the plane.

7. The dispensing device of claim 6, wherein the circumferential wall is substantially rigid.

8. The dispensing device of claim 1, wherein the valve is a flapper valve.

9. The dispensing device of claim 2, further comprising a closure for the exit valve.

10. The dispensing device of claim 1, wherein a nozzle is incorporated at an end of the exit pathway.

11. A dispensing device, comprising:

a collapsible container maintaining a material to be dispensed having an opening passing from an interior to an exterior of the collapsible container;

a one-piece upper member having a dome button, a valve positioned within the dome button and a top portion extension extending distally from the dome button, the one-piece upper member being sealed to the exterior of the collapsible container about the opening to define a metering chamber, and the valve being sealingly engaged with the opening;

an exit pathway formed between the top portion extension and the exterior of the collapsible container; and wherein activating forces applied concurrently to said dome button and said container activate said valve to cause passage of material from said metering chamber through said exit pathway formed by the top portion and the exterior of said container mated together, and activating forces applied to said dome button activate said valve to cause passage of material from said metering chamber into said container through said opening.

12. The dispensing device of claim 11, wherein the container is a pouch.

13. The dispensing device of claim 11, wherein the valve is a flapper valve.

14. The dispensing device of claim 11, further comprising an exit valve interposed in said exit pathway.

15. A method of dispensing a fluid, comprising:

providing a collapsible container having an outer surface with an opening thereon and an interior fluid storage region therein;

providing a volume of fluid within the interior fluid storage region;

providing a one-piece flexible pump assembly having a valve and dome button with a top portion extension extending thereof, the valve, dome button and top portion extension;

sealing the flexible pump assembly to the outer surface of the collapsible container around the opening so that the valve is positioned substantially above the opening and the top portion extension meets the outer container surface, a metering chamber being created between the flexible pump assembly and the outer surface of the collapsible container and an exit pathway being created between the top portion extension and the outer surface of the collapsible container;

providing an exit port in fluid communication with the top portion extension;

depressing the dome button of the flexible metering housing;

releasing the dome button;

filling the metering chamber with a volume of fluid by vacuum force in an amount by the volume of the metering chamber;

depressing the flexible metering housing again; and urging the volume of fluid within the metering chamber through the exit port via the exit pathway.

16. The method of claim 15, wherein the valve is a flapper valve.

17. The dispensing device of claim 11, wherein the one-piece upper member also comprises a circumferential wall having an upper rim positioned about the dome button, wherein the upper rim of the circumferential wall defines a plane, and an entirety of the dome is positioned below the plane.

18. The dispensing device of claim 17, wherein the circumferential wall is rigid.

19. The dispensing device of claim 1, wherein the collapsible pouch comprises of at least two sheets of flexible material.

20. The dispensing device of claim 11, wherein the collapsible container comprises of at least two sheets of flexible material.

* * * * *